US007540395B2

(12) United States Patent
Dhellemmes

(10) Patent No.: US 7,540,395 B2
(45) Date of Patent: Jun. 2, 2009

(54) SEALED WALL STRUCTURE AND TANK FURNISHED WITH SUCH A STRUCTURE

(75) Inventor: Jacques Dhellemmes, Versailles (FR)

(73) Assignee: Gaz Transport et Technigaz, Saint-Remy-les-Chevreuse (FR)

( * ) Notice: Subject to any disclaimer, the term of this patent is extended or adjusted under 35 U.S.C. 154(b) by 200 days.

(21) Appl. No.: 10/954,258

(22) Filed: Oct. 1, 2004

(65) Prior Publication Data

US 2005/0082297 A1 Apr. 21, 2005

(30) Foreign Application Priority Data

Oct. 16, 2003 (FR) ..... 03 12121

(51) Int. Cl.
*B65D 6/28* (2006.01)
*B65D 6/00* (2006.01)
*E04C 2/32* (2006.01)

(52) U.S. Cl. ..... 220/608; 220/669; 52/630

(58) Field of Classification Search ..... 220/608, 220/669, 644, 645; 52/630
See application file for complete search history.

(56) References Cited

U.S. PATENT DOCUMENTS 2,870,981 A * 1/1959 Dellinger et al. ..... 108/52.1
3,547,302 A * 12/1970 Massac et al. ..... 220/560.08
3,824,664 A * 7/1974 Seeff ..... 428/604
5,115,936 A * 5/1992 Bartlow ..... 220/567.1

FOREIGN PATENT DOCUMENTS

| | | |
|---|---|---|
| FR | 1 376 525 | 10/1964 |
| FR | 1 379 651 | 11/1964 |
| FR | 2 781 557 | 1/2000 |

* cited by examiner

*Primary Examiner*—Anthony D Stashick
*Assistant Examiner*—Shawn M Braden
(74) *Attorney, Agent, or Firm*—Young & Thompson

(57) ABSTRACT

A sealed wall structure includes at least one sealed plate (10), the plate (10) being corrugated with at least one first series of corrugations and a second series of corrugations (6) of transverse directions, the corrugations protruding toward the internal face of a tank. The structure includes at least one reinforcing ridge (11) made on at least one corrugation of a series in its portion lying between two successive intersections (8) with corrugations of the other series, each ridge (11) being generally convex and made locally on at least one lateral face (6*b*) of the corrugation that supports it.

12 Claims, 7 Drawing Sheets

SEALED WALL STRUCTURE AND TANK FURNISHED WITH SUCH A STRUCTURE

The present invention relates to a sealed wall structure intended in particular for the internal lining of a sealed and thermally insulating tank integrated into a supporting structure, and said tank furnished with this structure.

Known particularly through the European patents No. 248 721 and No. 573 327, there is a sealed wall structure intended for the internal lining of a sealed and thermally insulating tank C integrated into a supporting structure, said tank shown in FIG. 1 of the appended drawings, comprising two successive sealing barriers illustrated in FIG. 2, one primary 1 in contact with the product contained in the tank, consisting of said sealed wall structure, and the other secondary 2 disposed between the primary barrier 1 and the supporting structure 13, these two sealing barriers being alternated with two thermally insulating barriers, the primary insulation barrier 3 and the secondary insulation barrier 4.

French patents No. 1 376 525 and No. 1 379 651 describe a sealed wall structure represented in FIG. 3 and comprising sealed corrugated plates 10 with, on their internal face, a first series of corrugations called longitudinal corrugations 5 and a second series of corrugations called transverse corrugations 6, the respective directions of which are perpendicular, said first series of corrugations 5 being of lesser height than the second series of corrugations 6 such that the corrugations of the first series of corrugations 5 are discontinuous at their intersection 8 with the corrugations of the second series of corrugations 6 which are continuous. At the intersections 8 between corrugations of the first series of corrugations 5 and the second series of corrugations 6, the crest 6*a* of the transverse corrugation 6 comprises a pair of concave undulations 7*a* and 7*b* the concavity of which is turned toward said internal face and which are disposed either side of the longitudinal corrugation 5. The transverse corrugation 6 comprises, in addition, at each intersection, a lateral reinforcement 9 into which the longitudinal corrugation 5 penetrates, either side of the transverse corrugation.

This wall structure is well suited to resisting the hydrostatic pressure exerted on the internal lining of a large-capacity tank, for example of the order of 138000 $m^3$. However, for tanks of greater capacity or for partial filling of conventional ships, for example of the order of 138000 $m^3$, the hydrostatic pressure exerted by the product contained in the tank, for example liquid gas, may cause significant plastic deformation of the corrugations and particularly crushing of the lateral faces of the corrugations of the second series of corrugations at some distance from the intersections between the corrugations of the second series of corrugations and the first series of corrugations. In such tanks integrated into the supporting structure of a ship, the swell motions of the liquid gas against the lateral walls of the tank during transport may also cause dynamic pressure shocks such that the corrugations also suffer significant plastic deformation. Such deformation may lead to a deterioration of the mechanical strength of the plates which are subject to significant thermal contractions, for example when they receive liquid methane, and thus damage the sealing of the plates, in particular in the weld zones 12 at the junction between the various plates of the sealed wall (see FIG. 2).

One solution could consist in increasing the thickness of the plates, but in addition to the marked increase in cost, this increased thickness could lead to stiffening of the corrugations and would therefore impair the flexibility of the plates which is required to allow them to contract thermally without risk of breaking the seal.

The object of the invention is to propose a new sealed wall structure which avoids the aforementioned disadvantages and which allows the corrugations of the plates to withstand greater pressures.

Accordingly, the subject of the invention is a sealed wall structure, intended in particular for the internal lining of a sealed and thermally insulating tank integrated into a supporting structure, of the type comprising at least one sealed plate of which one face, called the internal face, is intended to be in contact with a fluid, said plate being corrugated with at least a first series of corrugations and a second series of corrugations the respective directions of which are secant, said corrugations protruding on the side of said internal face, characterized in that it comprises at least one reinforcing ridge made on at least one corrugation of one of the aforementioned series of corrugations in its portion lying between two successive intersections with corrugations of the other series of corrugations, each ridge being generally convex with its convexity protruding on the side of said internal face, or of its opposite face called the external face, said ridge being made locally on at least one lateral face of the corrugation that supports it.

Advantageously, the first series of corrugations is of lesser height than the second series of corrugations such that the corrugations of the first series of corrugations are discontinuous at their intersection with the corrugations of the second series of corrugations which are continuous and in that, at the intersections between corrugations of the first series of corrugations and the second series of corrugations, the crest of the corrugation of the second series comprises a pair of concave undulations whose concavity is turned toward said internal face and which are disposed either side of the corrugation of the first series.

According to another feature of the invention, the aforementioned ridges are provided on at least certain of the corrugations of the second series of corrugations.

According to a first variant, each ridge extends continuously from one lateral face to the other corrugation which supports it while passing through its crest.

According to a second variant, each ridge extends only over one lateral face of the corrugation that supports it at some distance from the crest and from the feet of said corrugation.

Advantageously, each ridge is substantially midway between two successive intersections.

According to another feature of the invention, the ridge (ridges) present on one and the same portion of corrugation is (are) symmetrical relative to a plane perpendicular to the direction of said corrugation and situated substantially midway between two successive intersections.

Preferably, the ridge (ridges) is (are) symmetrical relative to a plane passing through the crest of the corrugation that supports it and perpendicular to the plane of the plate.

According to a particular form of the invention, the thickness of the plate at each ridge is as thick as or slightly thinner than the rest of the plate.

In a preferred embodiment of the invention, the internal radius of the ridge at the lateral faces of the corrugation is substantially equal to that of the crest of the corrugation that supports it.

Advantageously, the ratio of the height of the ridge to the height of the corrugation that supports it lies between 10% and 25%.

Preferably, each ridge has a direction extending generally in a plane perpendicular to the direction of the corrugation that supports it.

Another subject of the invention is a sealed and thermally insulating tank integrated into a supporting structure particularly of a ship, said tank comprising two successive sealing barriers, one of them primary in contact with the product contained in the tank, the other secondary disposed between the primary barrier and the supporting structure, these two sealing barriers being alternated with two thermally insulating barriers characterized in that the primary sealing barrier consists at least partially of said wall structure defined above.

According to a particular form of the invention, the plates of said wall structure are disposed in the upper zone of the tank.

The invention will be better understood and other aims, details, features and advantages of the latter will appear more clearly during the detailed explanatory description which follows, of several embodiments of the invention given purely as illustrative and nonlimiting examples, with reference to the schematic drawings appended.

In the following detailed description of the drawings, reference will be made to the transverse corrugations 6 to designate the corrugations of the second series of corrugations because their direction T is perpendicular to that of the length of the ship. Similarly, reference will be made to the longitudinal corrugations 5 to designate the corrugations of the first series of corrugations because their direction L is parallel to that of the length of the ship.

However, the invention also applies to longitudinal corrugations 5 consisting of corrugations of the first series, without departing from the context of the present invention.

The expression "generally convex" that is used to characterize the shape of the corrugation or of the ridges means that the major part is convex but that parts of the surface of the corrugation or of the ridges may be concave or otherwise like for example the connecting fillets between the surface of the plate and the lateral faces of the corrugation or of the ridges, and the trough zones of the corrugation or of the ridges.

Figure 1:
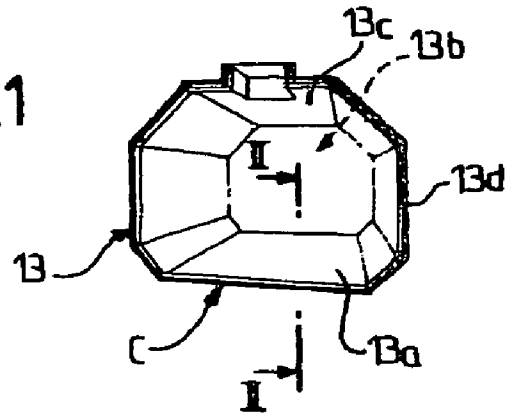
FIG. 1 is a partial schematic view in cross section and in perspective, of the interior of a conventional tank to which the present invention may apply.

FIG. 1 shows that the current tank C of a ship may conventionally comprise an octagonal transverse section, said tank C being integrated into a supporting structure 13 comprising in particular a bottom wall 13*a*, a ceiling wall 13*c*, lateral walls 13*d* and two transverse partitions 13*b* one of which is not shown.

Figure 2:
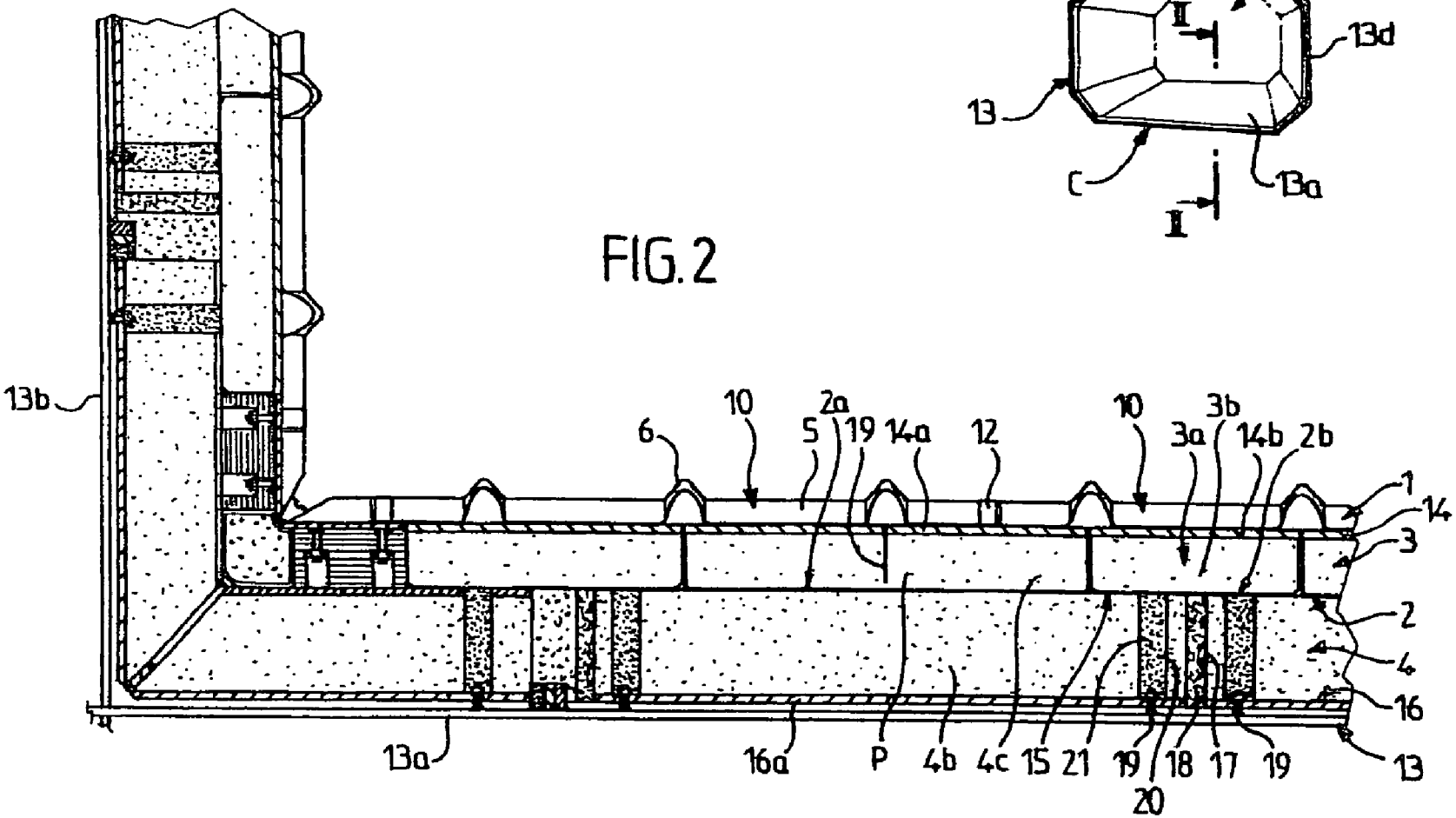
FIG. 2 is an enlarged, partial view, in cross section along line II-II in FIG. 1, at the angle of intersection between a transverse partition and a bottom wall of the double shell.

FIG. 2 shows the detailed structure of the sealed and thermally insulating tank C, for the transport of a cryogenic liquid and particularly of liquid methane, whose main elements will be described.

The primary sealing barrier 1 consists of a sealed wall structure comprising a plurality of sealed corrugated plates 10 whose internal face is intended to be in contact with the fluid.

The sealed plates 10 are thin metal elements such as sheets of stainless steel or of aluminum and are welded together at the aforementioned marginal overlap zones 12. The welds are of the lap welding type the process of which is described in detail for example in French patent No. 1 387 955.

The longitudinal corrugations 5 and transverse corrugations 6, which protrude toward the internal face of the tank C, allow the wall structure to be substantially flexible, so that it can deform under the effect of stresses, particularly those generated by thermal contraction and by the above-mentioned hydrostatic and dynamic pressures.

The primary insulation barriers 3 and secondary insulation barriers 4 are produced by means of panels designated by P in their entirety. A panel P has substantially the shape of a rectangular parallelepiped; it consists of a first plate 16*a* of wood veneer topped with a first layer of thermal insulation 4*b*, itself topped with a cloth 2*a* consisting of a material comprising three layers (triplex): the two outer layers are glass fiber cloths and the intermediate layer is a thin metal sheet; onto this cloth 2*a* is bonded a second layer of insulation 4*c* which itself supports a second plate of wood veneer 14*a*.

The second subassembly (4*b* and 16*a*) which constitutes the secondary insulation barrier 4 is thicker than the first subassembly (4*c* and 14*a*) which constitutes the primary insulation barrier 3.

The thermal insulation layers (4*b* and 4*c*) consist of a sealed thermal insulation material, particularly a plastic or synthetic closed-cell foam based on polyurethane or polyvinyl chloride.

The panel P that has just been described may be prefabricated in order to form an assembly whose various components are bonded to one another in the disposition indicated above; this assembly therefore forms the primary 3 and secondary 4 insulation barriers. The panels P are attached to the supporting structure 13 by means known per se such as studs 19 welded to a wall 13*a*, 13*b*, 13*c* or 13*d* of the supporting structure 13 and passing through matching holes of the first plate 16*a* of wood veneer.

These studs 19 are placed opposite recesses 20 themselves formed through the layers 4*b* at some distance from the spaces 17 between the second subassemblies (4*b* and 16*a*) of the panels P. These recesses 20 are filled with an insulating packing material 21.

Additionally, in the spaces 17 which separate the second subassemblies (4*b* and 16*a*) of two adjacent panels P can be placed a thermal insulation material 18 consisting for example of a sheet of foam folded onto itself in U shape and forced into a space 17. Thus, the continuity of the secondary insulation barrier 4 has been reconstituted. A flexible tape 2*b* is bonded to the peripheral edge 15 existing between the layers 4*b* and 4*c* of one and the same panel P and extends to the peripheral edge of the adjacent panel P. The flexible tape 2*b* consists of a composite material comprising three layers (triplex).

The triplex cloth 2*a* which covers the subassembly (4*b* and 16*a*) and the flexible tape 2*b* constitute the secondary sealing barrier 3.

Between the first subassemblies (4*c* and 14*a*) of two adjacent panels P, insulating slabs 3*a* each consisting of a layer of a thermal insulator 3*b* and of a wood veneer plate 14*b* are placed on the tapes 2*b*. The dimensions of the slabs 3*a* are such that, after they have been put in place, their plate 14*b* provides a continuity between the plates 14*a* of the adjacent panels P.

The plate assembly (14*a* and 14*b*) forms an internal distribution layer 14 and the plate assembly 16*a* forms an external distribution layer 16. These internal 14 and external 16 distribution layers are used to distribute, somewhat uniformly throughout the insulation layers 3 and 4, the forces relating to the deformations of the primary sealing barrier 1.

In the plates 14*a* and the thermal insulation layers 4*c*, a plurality of slits 19 are made extending in the direction transverse to the length of the ship. These slits are present in order to prevent the primary insulation barrier 2 from splitting in an uncontrolled manner when the tank is cooled.

The general structure of the tank C that has just been described and that of the corner of the tank C defined by the intersection between a transverse partition 13*b* and the bottom wall 13*a* of the double shell are described in greater detail in French patent No. 2781557.

A more specific description will now be given of the wall structure forming the primary sealing barrier 1.

Figure 3:
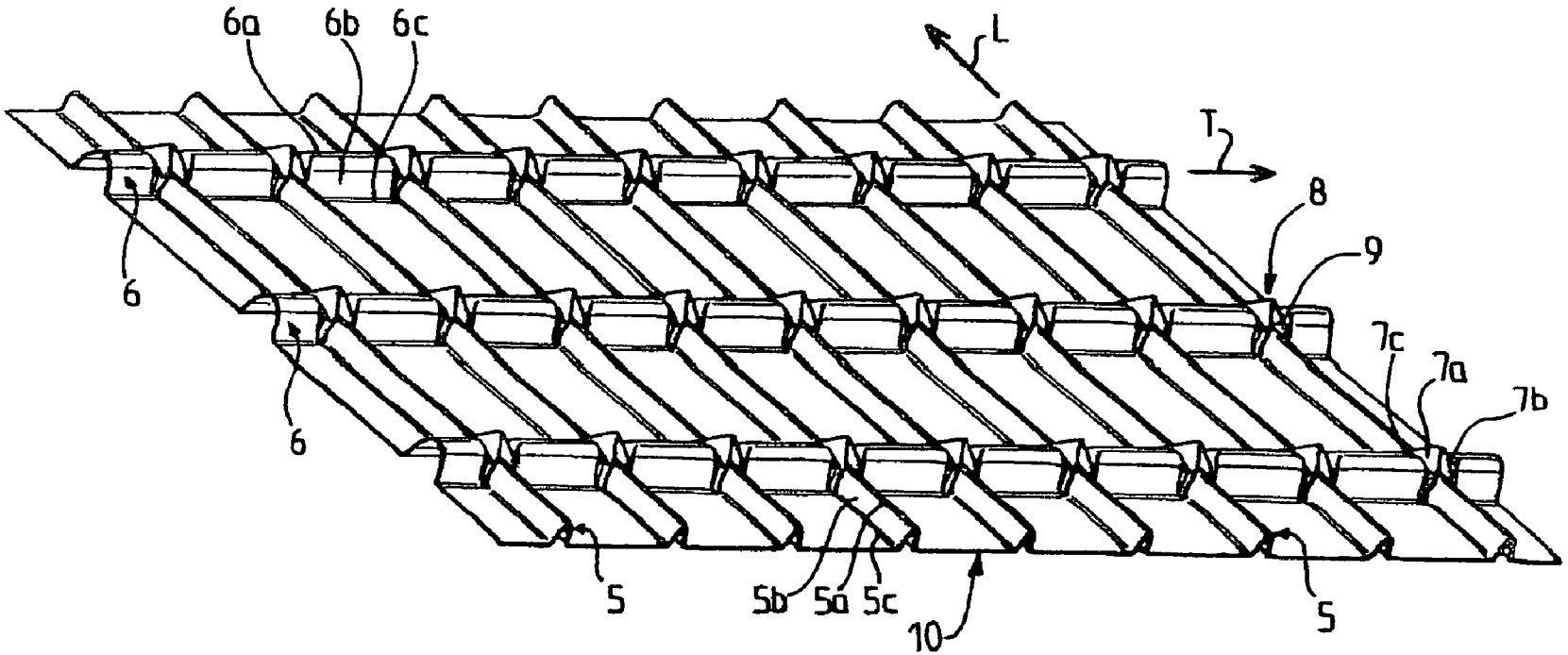
FIG. 3 is a top view in perspective of a conventional sealed plate.

FIG. 3 shows that each of the longitudinal corrugations 5 and transverse corrugations 6 has a crest 5*a* and 6*a*, lateral faces 5*b* and 6*b* and a trough 5*c* and 6*c* respectively. They also have a semi-elliptical profile. In addition, it shows that the undulations 7*a* and 7*b* also have a semi-elliptical or triangular profile.

Figure 4:
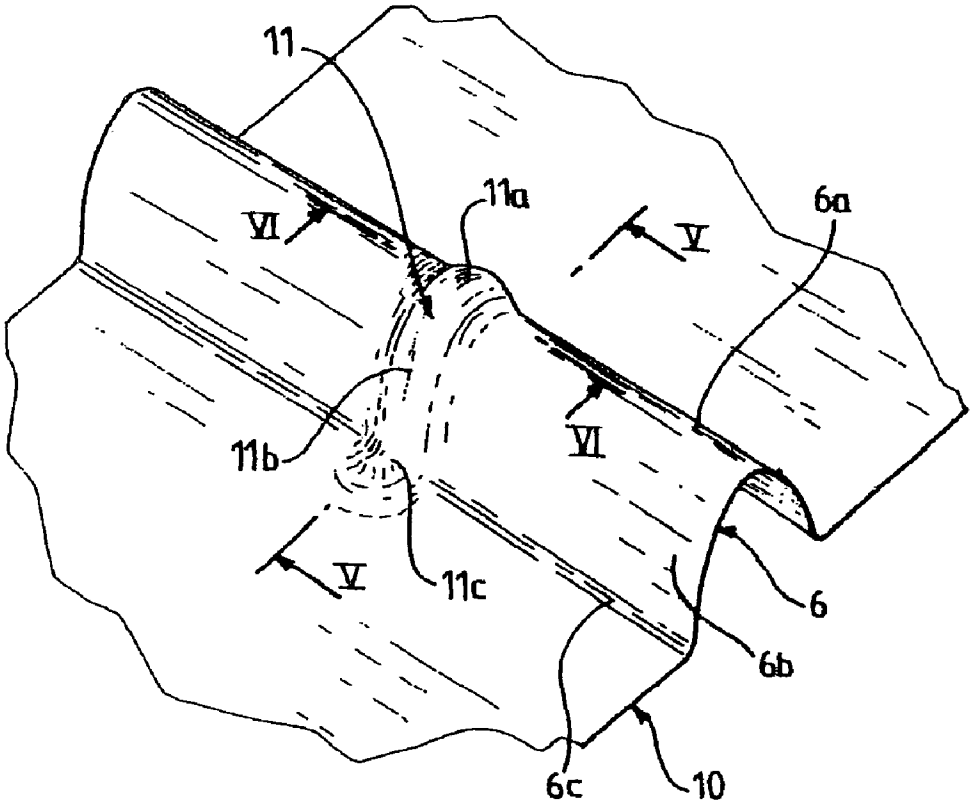
FIG. 4 is a partial view in perspective and enlarged of a plate according to a first embodiment of the wall structure according to the invention.

FIG. 4 shows a transverse corrugation 6 in its portion lying between two successive intersections 8, but the intersections 8 have not been shown for simplicity.

Figure 5:
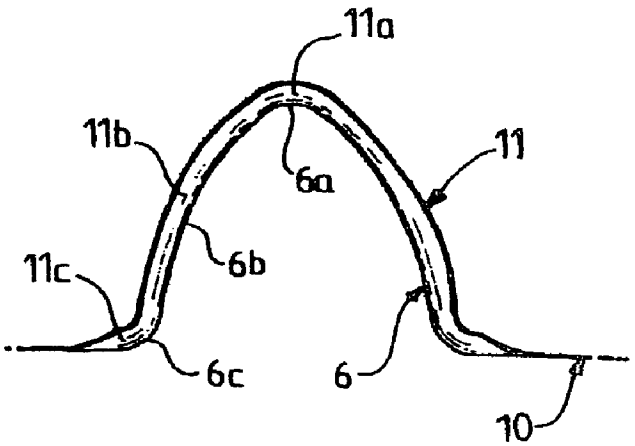
FIG. 5 represents a section along line V-V in FIG. 4.
Figure 6:
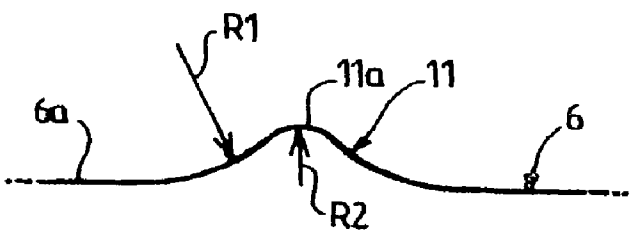
FIG. 6 represents a section along line VI-VI in FIG. 4.

According to a first embodiment of the invention, illustrated in FIGS. 4 to 6, a reinforcing ridge 11 is made on a transverse corrugation 6 midway between the intersections 8, because in this portion of corrugation 6, the lateral faces 6*b* have a greater tendency to deform under the stress of high hydrostatic and dynamic pressures.

In addition, according to the spacing between two successive intersections 8, one or more ridges 11 may be made on a transverse element 6 in its portion lying between said successive intersections 8.

The ridge 11 is generally convex as was defined above, with a protruding convexity on the side of said internal face of the plate 10.

The convexity of the ridges 11 is formed for example by stamping.

FIGS. 4 to 6 show that each ridge 11 extends continuously from one lateral face 6*b* of the corrugation 6 to the other lateral face 6*b* passing through the crest 6*a*. The height of the ridge is then substantially constant all along the portion 11*b* lying between the foot 11*c* and the summit 11*a* of the ridge 11, and reduces in the vicinity of the foot 11*c* of the ridge 11 in order progressively to espouse the flat surface of the plate 10. Advantageously, this height will be approximately 5 mm.

FIG. 6 shows that the ridge at its summit 11*a* has two distinct radii of curvature: R1, the radius of curvature of the connecting fillet between the crest 6*a* of the transverse corrugation 6 and the summit 11*a* of the ridge 11, and R2, the internal radius of curvature of the ridge 11 at its summit 11*a*. The centers of curvature associated with these radii R1 and R2 are situated either side of the plate 10. The increase of R1 is used to minimize the concentration of stresses on the ridge 11 and that of R2 has the effect of stiffening the ridge 11. The radii of curvature R1 and R2 are for example of the order of 20 mm and 5 mm respectively.

As an example, the longitudinal corrugations 5 have a defined height between the crest 5*a* and the surface of the plate 10 equal to approximately 36 mm and a distance separating the two troughs 5*c* of the same corrugation 5 of the order of 53 mm. However, the transverse corrugations 6 have a defined height between the crest 6*a* and the surface of the plate 10 of the order of 54.5 mm and a distance separating the two troughs 6*c* of the same corrugation 6 of approximately 77 mm. Because the surface of the lateral faces 5*b* of the longitudinal corrugations 5 is smaller than that of the lateral faces 6*b* of the transverse corrugations 6 and because the hydrostatic pressure is applied perpendicularly to said surface of the plate 10, the longitudinal corrugations 5 are more resistant to this pressure. However, it is possible to apply ridges to the longitudinal corrugations 5 also.

It is also possible to apply the ridges to longitudinal corrugations 5 or transverse corrugations 6 having a triangular profile.

The effectiveness of the resistance to major pressures, conferred by the reinforcing ridges 11, has been demonstrated by various simulations made by computations on the finished elements.

These simulations have been made on a transverse corrugation 6 whose dimensions have been previously defined.

Figure 7B:
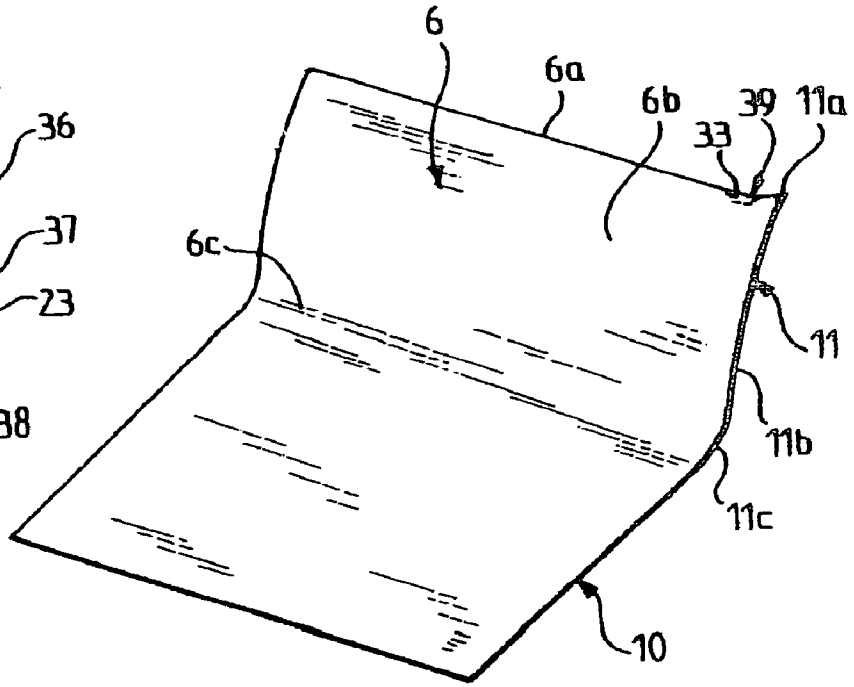
FIG. 7B is a partial view in perspective of a plate according to the invention, illustrating the elongation of a corrugation subject to a high hydrostatic pressure.

The first outputs of the results of these simulations are the elongations of the plate 10 at the lateral faces 6*b* of two transverse corrugations 6 subjected to a high hydrostatic pressure, one of them having no reinforcing ridge 11 (FIG. 7A) and the other exhibiting such a ridge (FIG. 7B). The elongation is the ratio of the surface of a deformed portion of a part of the corrugation 6 (crest 6*a*, lateral face 6*b* or trough 6*c*) under pressure, to the surface of said portion without pressure.

The portion of corrugation shown in FIG. 7B is the portion lying between the vertical mid-plane passing through the crest 6*a* of the transverse corrugation 6, the vertical plane passing through the trough 5*a* of the longitudinal corrugation 5 constituting an intersection 8 with said transverse corrugation 6, and the vertical plane passing through the summit 11*a* and the foot 11*c* of the ridge 11 (that is to say the front left quarter part of FIG. 4).

Figure 7A:
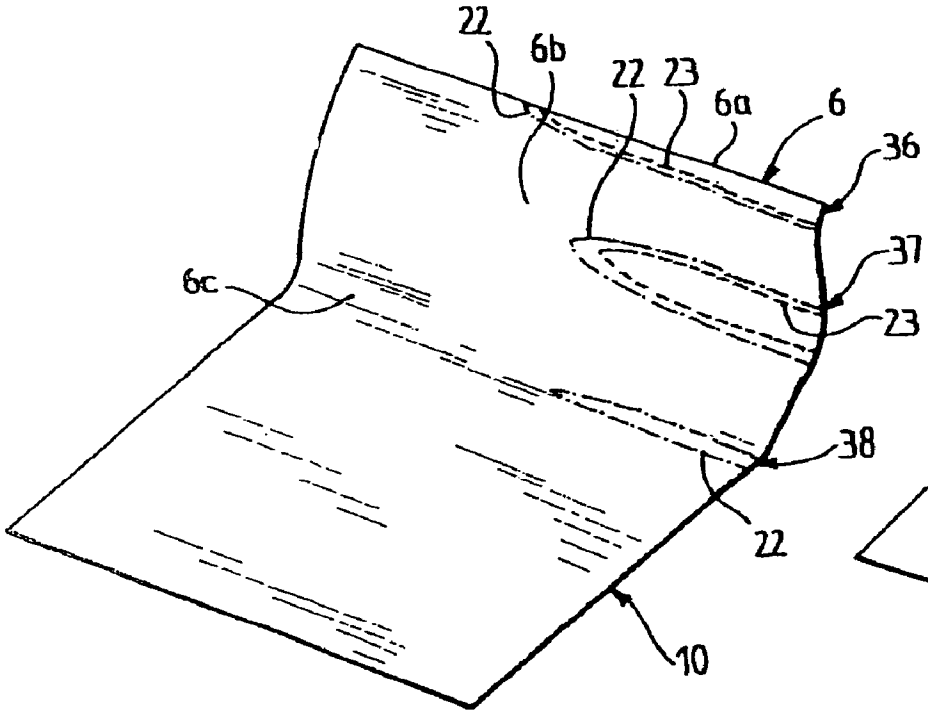
FIG. 7A is a partial view in perspective of a conventional plate, illustrating the elongation of a corrugation subject to a high hydrostatic pressure.

The portion of corrugation 6 shown in FIG. 7A is the same portion as that illustrated in FIG. 7B except that it corresponds to a corrugation without ridge, that is to say the portion lying between the vertical mid-plane passing through the crest 6*a* of the transverse corrugation 6, the plane vertical to said corrugation 6 passing through the trough 5*a* of the longitudinal corrugation 5 forming an intersection 8 with said transverse corrugation 6, and the vertical plane passing midway between two successive intersections 8.

The transverse corrugation 6 having no reinforcing ridge 11 is subject to a pressure of 7.07 bar (FIG. 7A) whereas the transverse corrugation 6 having a reinforcing ridge 11 is subject to a slightly higher pressure of 7.50 bar (FIG. 7B).

The transverse corrugation 6 with no reinforcing ridge 11 exhibits a significant elongation at a distance from the intersection 8 (the intersection 8 forming a relatively rigid zone of the plate, less susceptible to deformation under the effect of high hydrostatic pressures).

Specifically, the elongation is localized in three distinct regions 36, 37 and 38 of the transverse corrugation 6. A first region 36, positioned at the crest 6*a* of the transverse corrugation 6 at a distance from the intersection 8, comprises elongation zones 22 and 23 delimited by the dot-and-dash lines and dotted lines respectively, elongation of 1.43 to 2% and more than 2% respectively. The region 36 also exhibits a maximum elongation of approximately 4.69%. A second region 37, positioned at the lateral face 6*b* of the transverse corrugation 6 at a distance from the intersection 8, also comprises the aforementioned zones 22 and 23. Finally, a final region 38, positioned at the trough 6*c* of the transverse corrugation 6 at a distance from the intersection 8, comprises only the zone 22, that is to say an elongation less than approximately 2%.

These regions, 36, 37 and 38 are concentrated midway between two successive intersections 8. This first of all confirms that the intersections 8 stiffen the wall structure because a significant elongation is observed only at a distance from said intersection 8. This also confirms that the corrugations 6 without ridges 11 have a zone of weakness when exposed to the stresses due to the high pressures, at some distance from said intersection 8.

On the other hand, the corrugation with a reinforcing ridge 11 has no significant elongation of its lateral faces 6*b* (FIG. 7B) despite a slightly higher pressure.

Specifically, the elongation of the corrugation 6 is localized here only in a region 39. This region 39, positioned at the crest 6*a* of the transverse corrugation 6 at some distance from the intersection 8, has an elongation zone 33 delimited by the dotted lines, an elongation of more than 2%. It also exhibits a maximum elongation of 2.37%.

In addition, the region 39 exhibits an elongation zone 33 much smaller than the zone 23 of the aforementioned regions 36 and 37 and a maximum elongation of approximately 2.37%, which is much less than the maximum elongation of the region 36.

The ridge 11 therefore contributes to making the aforementioned wall structure more resistant to the pressure stresses by forming a relatively more rigid zone midway between the intersections 8.

Figure 8B:
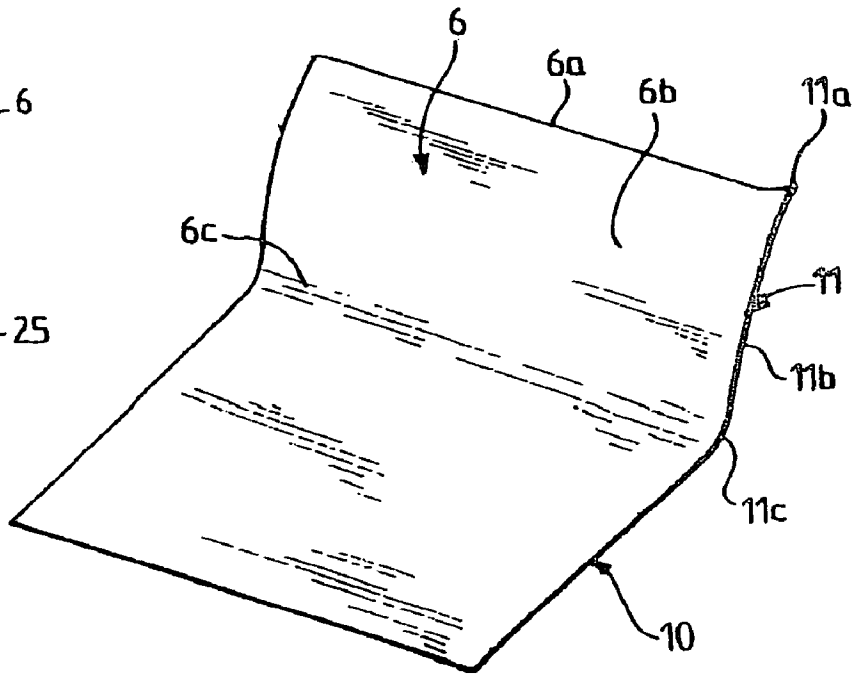
FIG. 8B is a partial view in perspective of a plate according to the invention, illustrating the crushing of a corrugation subject to a high hydrostatic pressure.

The second outputs of the results of these simulations are the crushing of the plate 10 at the lateral faces 6*b* of two corrugations 6 subjected to a high hydrostatic pressure, one of them having no reinforcing ridge 11 (FIG. 8A) and the other having such a ridge (FIG. 8B). The crushing is the distance between a point of a part of the corrugation 6 (crest 6*a*, lateral face 6*b* or trough 6*c*) deformed under pressure and the same point without pressure.

Figure 8A:
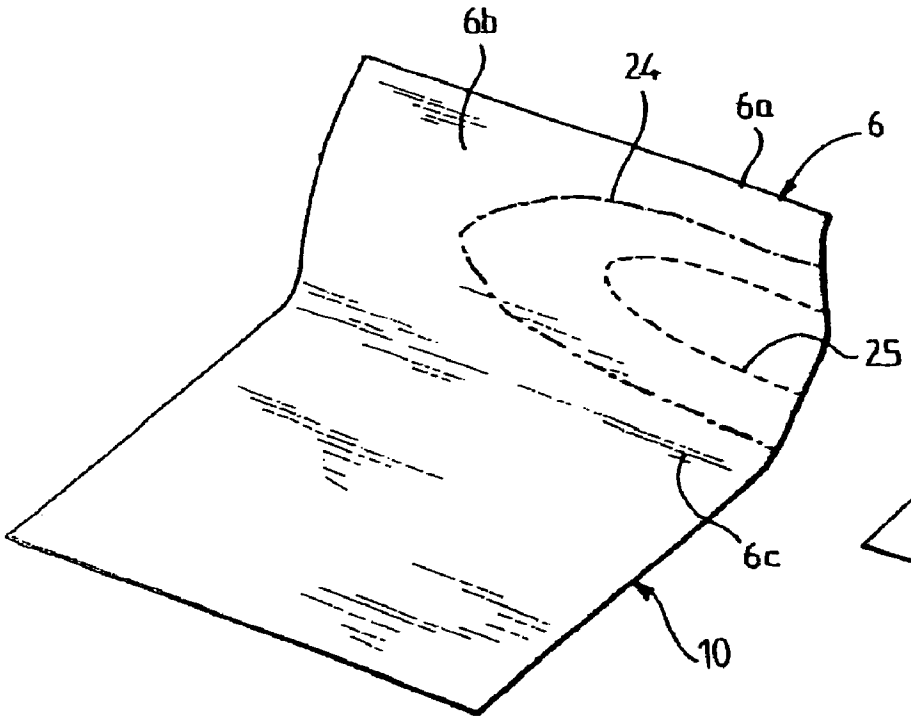
FIG. 8A is a partial view in perspective of a conventional plate, illustrating the crushing of a corrugation subject to a high hydrostatic pressure.

The portion of corrugation 6 represented in FIG. 8A is the same as that shown by FIG. 7A. Likewise, the portion of corrugation 6 represented in FIG. 8B is the same as that shown in FIG. 7B.

The transverse corrugation 6 having no reinforcing ridge 11 is subject to a pressure of 7.07 bar (FIG. 8A) whereas the transverse corrugation 6 with a reinforcing ridge 11 is subject to a slightly higher pressure of 7.50 bar (FIG. 8B).

The transverse corrugation 6 having no reinforcing ridge 11 exhibits significant crushing at some distance from the intersection 8. The maximum computed crushing is of the order of 8.53 mm. The zones 24 and 25 surrounded by the dot-and-dash and the dashed lines respectively are zones whose crushing is from 2 to 6 mm and more than 6 mm respectively (FIG. 8A).

In this second output of results, these zones 24 and 25 are also concentrated midway between two successive intersections 8 and at mid-height of the corrugation 6. This confirms first of all that the intersections 8 stiffen the wall structure because significant crushing is observed only at a distance from said intersection 8 at the lateral faces 6*b* of the corrugation 6. This again confirms that the transverse corrugations 6 without ridges 11 have a zone of weakness when exposed to the stresses due to the high pressures, at some distance from said intersection 8.

However, the transverse corrugation 6 furnished with a reinforcing ridge 11 exhibits no significant crushing of its lateral faces 6*b* (FIG. 8B). Specifically, the maximum computed crushing is of approximately 1.67 mm.

These two outputs of simulation results therefore prove that the reinforcing ridge 11 gives the wall structure a significant resistance to the stresses due to the hydrostatic and dynamic pressure at some distance from the intersections 8 and that it therefore constitutes a significant reinforcement for the aforementioned wall structure. The role of the reinforcing ridge 11 is similar to that of the intersections 8 and the installation of said ridges 11 would thus make it possible to space out the intersections and therefore make plates 10 of greater dimension. If the dimensions of the plates are greater, then fewer plates have to be welded. This therefore reduces the time of building the aforementioned wall structure which therefore constitutes a saving.

Figure 9:
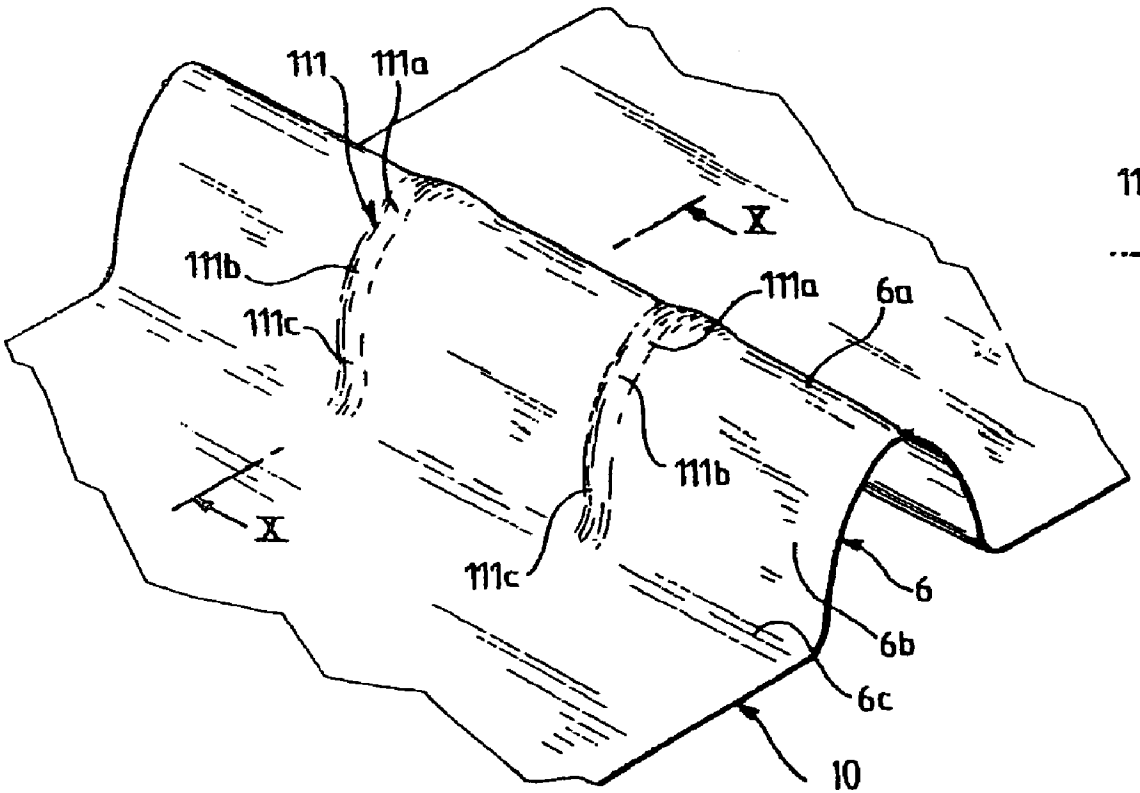
FIG. 9 is a view similar to FIG. 4 but representing a second embodiment of the invention.

The portion shown in FIG. 9 is substantially the same as that shown in FIG. 4. Here again, said intersections 8 have not been shown in order to simplify the figure.

Figure 10:
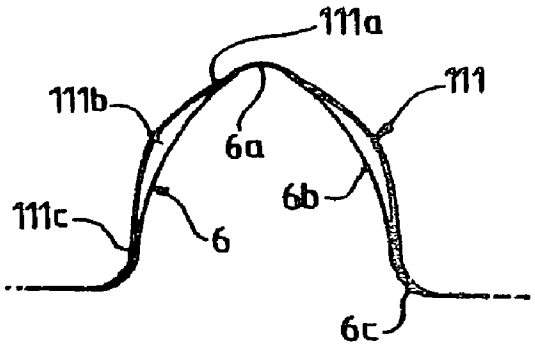
FIG. 10 represents a section along line X-X in FIG. 9.

However, according to a second embodiment shown in FIGS. 9 and 10, it can be seen that a ridge 111 in this case can be provided on each lateral face 6*b* of the corrugation 6 which supports it at a distance from the crest 6*a* and from the troughs 6*c*.

In this second embodiment, the summit 111*a* of the ridge 111 is situated below the crest 6*a* of the corrugation 6 that supports it whereas the summit 11*a* of the ridge 11 of the preceding embodiment is above the crest 6*a* of the corrugation 6 that supports it. Conversely, the foot 111*c* of the ridge 111 is situated above the trough 6*c* whereas the foot 11*c* of the ridge 11 of the preceding embodiment is at the level of the trough 6*c*. Finally, the part 111*b* lying between the summit 111*a* and the foot 111*c* of the ridge 111 protrudes above the lateral face 6*b* of the corrugation 6 as did the part 11*b* lying between the summit 11*a* and the foot 11*c* of the ridge 11.

The aforementioned radii of curvature R1 and R2, determining the form of the ridge on the surface of the plate 10 at the lateral parts 111*b*, may be of the order of 20 mm and 9.4 mm respectively (the radii of curvature R1 and R2 not being shown for this embodiment).

In addition, here two pairs of ridges 111 are provided at regular intervals between two successive intersections 8. These two pairs of ridges may advantageously be symmetrical with one another relative to a plane perpendicular to the direction T and passing midway between two successive intersections 8. In addition, one and the same pair of ridges may advantageously be symmetrical relative to a plane parallel to the direction T and passing through the crest 6*a*. Naturally, the invention can provide a larger number of ridges.

Figure 11:
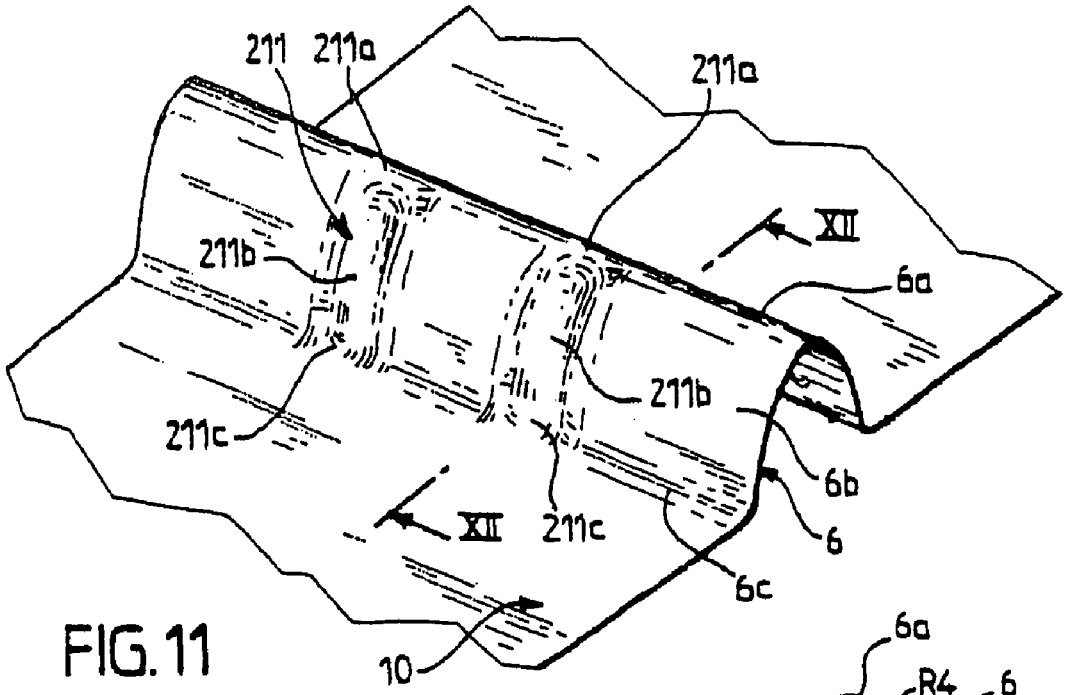
FIG. 11 is a view similar to FIG. 4, but representing a third embodiment of the invention.
Figure 12:
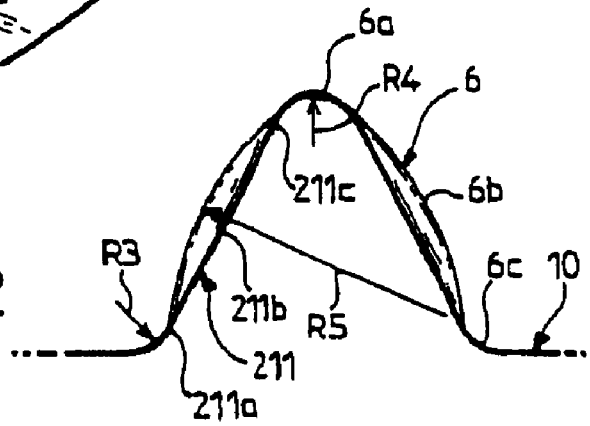
FIG. 12 represents a section along line XII-XII in FIG. 11.

According to a third embodiment illustrated in FIGS. 11 to 13, it can be seen that each ridge 211 may be generally convex with a convexity turned toward the external face of the plate 10. The ridges 211 have the same positioning on the corrugation 6 that supports them as the ridges 111, that is to say per pair, on each lateral face 6*b* and at some distance from the crest 6*a* and from the troughs 6*c* of the corrugation 6.

In this embodiment, the summit 211*a* of the ridge 211 and the foot 211*c* of the ridge 211 have an identical positioning relative to the lateral faces 6*b* of the corrugation 6 as in the previously described embodiment. However, the part 211*b* lying between the summit 211*a* and the foot 211*c* of the ridge 211 is made as an indentation in the lateral face 6*b* of the corrugation 6.

FIG. 12 shows that the transverse corrugation 6 of semi-elliptical profile has three distinct radii of curvature: R3 the radius of curvature of the connecting fillet between the plate 10 and the lateral face 6*b* of the corrugation 6, R4 the internal radius of curvature at the crest 6*a*, and R5 the radius of curvature of the lateral faces 6*b* of the corrugation 6. The radii R3, R4 and R5 are for example of the order of 8.4 mm, 9.4 mm and 65.4 mm respectively. As an example, the longitudinal corrugation 5 of semi-elliptical profile (not shown in FIG. 12) also has the aforementioned three radii of curvature R3, R4 and R5 that are of the order of 8.4 mm, 8.4 mm and 38.4 mm respectively.

In the case shown in FIG. 12, the depth of the ridge 211 is 5.06 mm.

The ridge 211 has planes of symmetry passing through the lines 26 and 27 which are respectively perpendicular and parallel to the direction T of the corrugation 6 while passing through the middle of the ridge 211.

According to an embodiment shown in FIGS. 12 and 13, the web of the ridge 211 is substantially rectilinear.

In addition, the ridges 211 of the third embodiment have at least as good a strength as that of the ridges 111 of the second embodiment with a depth of ridge 211 less than the height of the ridges 111. It may therefore be advantageous to furnish the aforementioned wall structure with ridges 211 of the third embodiment. If the installation of the ridges 211 requires a shallower stamping than for the ridges 111, the reduction of the thickness of the plate 10, in this location, due to the stamping will then be less, the plate 10 will be less fragile at the ridges 211 which will be more resistant to the pressure stresses. As an example, the plate 10 has a thickness of approximately 1.2 mm.

A same wall structure, even a same plate or a same corrugation, may simultaneously comprise ridges 11 and/or 111 and/or 211, on different series of corrugations 5 and 6, or on the same series of corrugations 5 or 6, or yet on the same portion of corrugations 5 or 6 between two intersections 8, or finally in a same plane perpendicular to the corrugation 5 or 6 that supports them, on the lateral opposite faces 5*b* and 6*b* of the corrugation 5 or 6 that supports them.

According to another variant of the invention, the web of the ridge 211 has a curvature symmetrical to that of the lateral face 6*b* relative to the plane passing through the foot 211*c* and the summit 211*a* of the ridge 211 parallel to the direction T of the corrugation 6. The installation of this type of curvature has the advantage of obtaining a depth of ridge 211 greater than that of the ridge 111 previously described without radius of curvature at the bottom of the ridge 111 (up to 25% relative to the height of the corrugation 5 or 6), which results in an increase in the resistance of this variant of the ridge 211.

Finally, a fabrication method for producing the aforementioned wall structure may comprise the following three steps:

The first consists in forming the corrugations of the second series of corrugations 6 by bending while giving said second series of corrugations 6 a triangular profile.

The second consists in simultaneously forming the corrugations of the first series of corrugations 5 by bending and the intersections 8, the corrugations of the first series of corrugations 5 possibly having acquired a semi-elliptical profile by this step.

The last step consists in the simultaneous production of the ridges 11, 111, 211 by stamping and of the semi-elliptical profile on the corrugations of the second series of corrugations 6, the forming of the semi-elliptical profile on the corrugations of the second series of corrugations 6 remaining optional.

Although the invention has been described in relation to several particular embodiments, it is clearly apparent that it is in no way limited to them and that it includes all the technical equivalents of the means described and their combinations if the latter form part of the context of the invention.

The invention claimed is:

1. A sealed wall structure, intended in particular for the internal lining of a sealed and thermally insulating tank (C) integrated into a supporting structure (13), comprising:

at least one sealed plate (10) of which an internal face is intended to be in contact with a fluid, said plate (10) being corrugated with at least a first series of corrugations (5) and a second series of corrugations (6) the respective directions (L, T) of which are transverse to each other, said corrugations protruding on a side of said internal face, each corrugation (5, 6) presents a crest (5*a*, 6*a*), lateral faces (5*b*, 6*b*) and troughs (5*c*, 6*c*), and said internal face comprises at least one reinforcing ridge (11, 111, 211) made on at least one corrugation of one of the aforementioned series of corrugations in its portion lying between two successive intersections (8) with corrugations of the other series of corrugations, each ridge (11, 111, 211) being generally convex with its convexity protruding on the side of an external face that is the opposite face of the internal face, said ridge (211) being made locally on at least one lateral face (5*b*, 6*b*) at some distance from the crest (5*a*, 6*a*) and from the troughs of the corrugation (5, 6) that supports it.

2. The wall structure as claimed in claim 1, wherein the first series of corrugations is of lesser height than the second series of corrugations such that the corrugations of the first series of corrugations (5) are discontinuous at their intersection (8) with the corrugations of the second series of corrugations (6) which are continuous and in that, at the intersections (8) between corrugations of the first series of corrugations (5) and the second series of corrugations (6), a crest (6*a*) of the corrugation of the second series (6) comprises a pair of concave undulations (7*a*, 7*b*) whose concavity is turned toward said internal face and which are disposed either side of the corrugation of the first series (5).

3. The wall structure as claimed in claim 1, wherein the ridges (11, 111, 211) are provided on more than one of the corrugations of the second series of corrugations (6).

4. The wall structure as claimed in claim 1, wherein that each ridge (111, 211) extends only over one lateral face (5*b*, 6*b*) of a corrugation (5, 6) that supports it at some distance from a crest (5*a*, 6*a*) and from feet (5*c*, 6*c*) of said corrugation (5, 6).

5. The wall structure as claimed in claim 1, wherein each ridge (11) is substantially midway between two successive intersections (8).

6. The wall structure as claimed in claim 1, wherein a ridge (11, l11, 211) present on a corrugation (5, 6) is symmetrical relative to a plane perpendicular to the direction (L, T) of said corrugation (5, 6) and situated substantially midway between two successive intersections (8).

7. The wall structure as claimed in claim 1, wherein the thickness of the plate (10) at each ridge (11, lll, 211) is as thick as or slightly thinner than the rest of the plate (10).

8. The wall structure as claimed in claim 1, wherein an Internal radius (R2) of the ridge (11, 111, 211) at the lateral faces (5*b*, 6*b*) of the corrugation (5, 6) is substantially equal to that (R4) of the crest (5*a*, 6*a*) of the corrugation (5, 6) that supports it.

9. The wall structure as claimed in claim 1, wherein that the ratio of the height of the ridge (11, 111, 211) to the height of the corrugation (5, 6) that supports it lies between 10% and 25%.

10. The wall structure as claimed in claim 1, wherein each ridge (11, 111, 211) has a direction extending generally in a plane perpendicular to the direction (L, T) of the corrugation (5, 6) that supports it.

11. A sealed and thermally insulating tank (C) comprising two successive sealing barriers, one (1) in contact with the product contained in the tank (C), the other (2) disposed between the one barrier (1) and the supporting structure (13), these two sealing barriers (1, 2) being alternated with two thermally insulating barriers (3, 4), wherein said one barrier (1) consists at least partially of the wall structure as claimed in claim 1.

12. The tank (C) as claimed in claim 11, wherein plates (10) of said wall structure are disposed in an upper zone of the tank (C).

* * * * *